US012760494B2

(12) United States Patent
Topf

(10) Patent No.: US 12,760,494 B2
(45) Date of Patent: Oct. 13, 2026

(54) EXCAVATOR BUCKET ATTACHMENT DEVICE

(71) Applicant: Henry Topf, Sugar Grove, OH (US)

(72) Inventor: Henry Topf, Sugar Grove, OH (US)

( * ) Notice: Subject to any disclaimer, the term of this patent is extended or adjusted under 35 U.S.C. 154(b) by 678 days.

(21) Appl. No.: 18/144,339

(22) Filed: May 8, 2023

(65) Prior Publication Data

US 2024/0376688 A1 Nov. 14, 2024

(51) Int. Cl.
*E02F 3/96* (2006.01)
*E02F 3/815* (2006.01)

(52) U.S. Cl.
CPC ..... *E02F 3/962* (2013.01); *E02F 3/8152* (2013.01)

(58) Field of Classification Search
CPC ..... E02F 3/8152; E02F 3/962; E02F 3/401; E02F 3/3604; E02F 3/404; E02F 3/815; Y10S 37/903
See application file for complete search history.

(56) References Cited

U.S. PATENT DOCUMENTS 4,189,854 A * 2/1980 Haynes ..... E02F 3/962 414/724
4,890,400 A * 1/1990 Long ..... E02F 3/40 37/409
5,596,825 A * 1/1997 Von Schalscha ..... E02F 3/962 172/701.3
5,775,013 A * 7/1998 Von Schalscha ..... E02F 3/962 172/701.3
5,918,389 A * 7/1999 Hall ..... E02F 3/8152 37/903
6,098,321 A * 8/2000 Logan ..... E02F 3/962 37/409
6,860,044 B2 * 3/2005 Keiper ..... E02F 3/3609 37/409
7,793,738 B2 * 9/2010 Frederick ..... E02F 3/8152 172/684.5
10,011,105 B2 * 7/2018 May ..... B32B 43/006
11,078,643 B1 * 8/2021 Dollar ..... E02F 9/245
2004/0040725 A1 * 3/2004 Stevens ..... A01B 45/00 172/748
2017/0297319 A1 * 10/2017 May ..... E02F 3/8152
2021/0324601 A1 * 10/2021 Dollar ..... E02F 3/401

* cited by examiner

*Primary Examiner* — Christopher J Sebesta
*Assistant Examiner* — Blake E Scoville
(74) *Attorney, Agent, or Firm* — Collier Legal, LLC; Josiah Collier

(57) ABSTRACT

A removeable attachment to an excavator bucket allowing for multi-purpose use of a single excavator without the need for lengthy modification or installation. The preferred embodiment is a grading blade attachment. The invention attaches to an excavator bucket by drilling holes into the bucket, inserting the coupling device of the invention between the bucket, and inserting a metal pin through the bucket and coupling device. The metal pin is secured by a lynch pin when installed. The attachment also has a circular piece of metal, allowing for the attachment to pivot with the contour of the ground during use and allowing more accurate use of construction cleanup equipment while reducing damage to landscape.

5 Claims, 5 Drawing Sheets

EXCAVATOR BUCKET ATTACHMENT DEVICE

CROSS-REFERENCE TO RELATED APPLICATIONS

Not Applicable

BACKGROUND OF THE INVENTION

This invention solves the problem of convenient use of grading blades in the prior art. The construction industry uses grading blades to efficiently clean up an excavator dig site without damaging grass or other landscape. There are currently very few options to attach a grading blade to an excavator, including: removing the bucket attachment and installing a grading blade attachment, or attaching a grading blade to an excavator bucket by fixed means, such as welding, bolting, or permanently installing supportive brackets.

These fixed means of attachment are slow and require effortful installation. The current methods of attaching a grading blade to an excavator bucket, requiring permanent affixture, change the structure of the excavator bucket and therefore limit the bucket's usefulness.

A further problem in the prior art exists in that the grading blades attached by fixed means to an excavator bucket do not pivot. This means they cannot adjust their level with the contour of the ground they are used on and are not as precise. Thus, more care is required when using these grading blades to avoid damaging the landscape.

This invention solves the problem by allowing for a grading blade to be quickly attached to an excavator bucket without effortful installation and without changing the structure of the bucket.

This invention also allows the grading blade to pivot with the contour of the ground. This reduces the amount of caution required by users and thus improves user efficiency.

BRIEF SUMMARY OF THE INVENTION

This invention is a grading blade that attaches to an excavator bucket through a coupling. The coupling is a rectangular piece of metal that attaches at the sides perpendicular to the longer sides. One end of the coupling includes a hollow tube for pin attachment. The opposite end of the coupling includes a circular hole for insertion of a Pivot Point that acts as a bolt in attachment to the grading blade.

To attach the coupling to an excavator bucket, a hole is drilled through the sides of the bucket. The coupling is inserted into the center of the bucket and a pin is inserted through the bucket holes and coupling. The pin is held through the holes by a lynch pin.

The coupling is attached to the grading blade by the pivot point. The pivot point is a cylinder piece of metal welded to the grading blade at approximately the center of the blade. The pivot point is inserted through a hole in the coupling and held in place by a spring pin.

A user can quickly install the grading blade by placing it within the excavator bucket and inserting the lynch pin. If not preassembled, the user can also quickly attach the coupling to the grading blade by placing the pivot point through the grading blade central hole and inserting the spring pin through the pivot point The pivot point allows the grading blade to swivel as it is pressed against the ground. This allows the blade to shift with the contour of the ground. Thus, the blade can be pressed against the ground with more accuracy and less caution to prevent damage to the landscape.

DETAILED DESCRIPTION OF THE INVENTION

Figure 1:
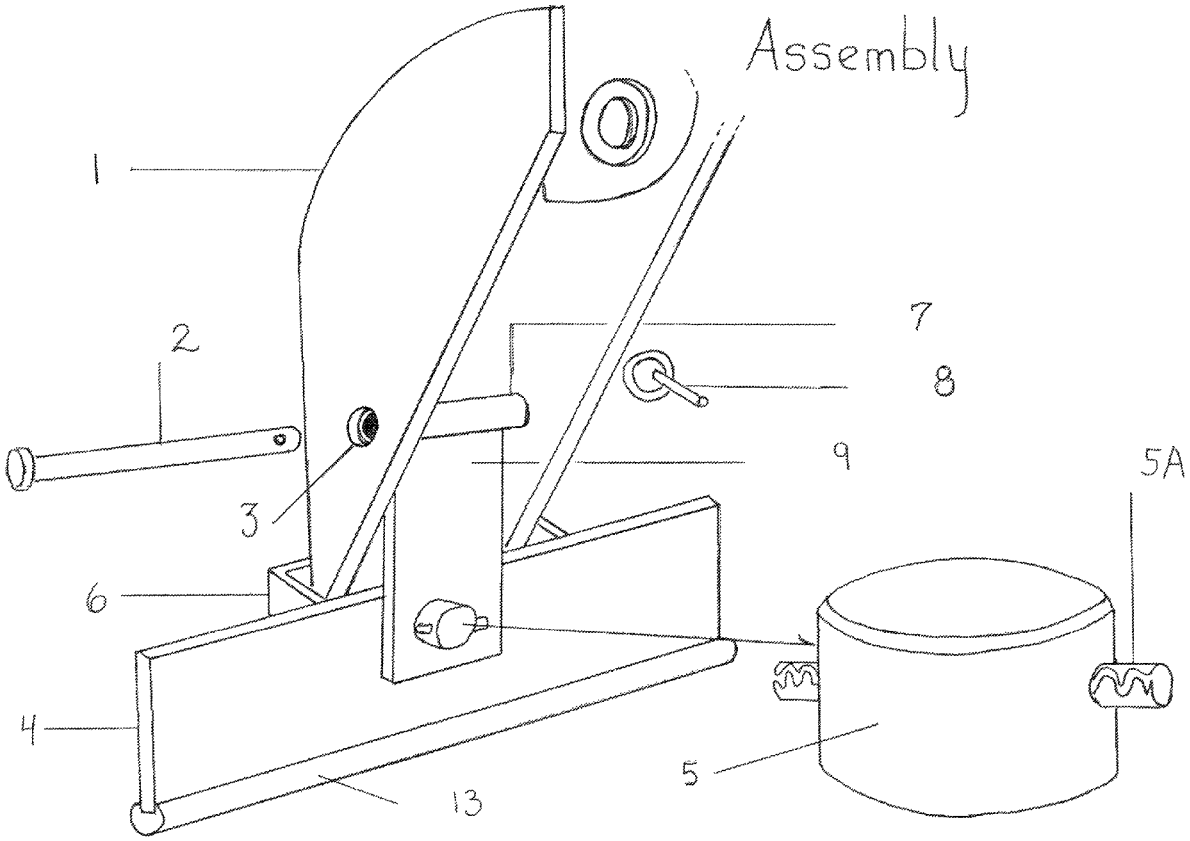
FIG. 1 is a side perspective diagrammatic view of the invention shown with the various components and showing the components of attachment to the excavator bucket in an exploded configuration.
Figure 3:
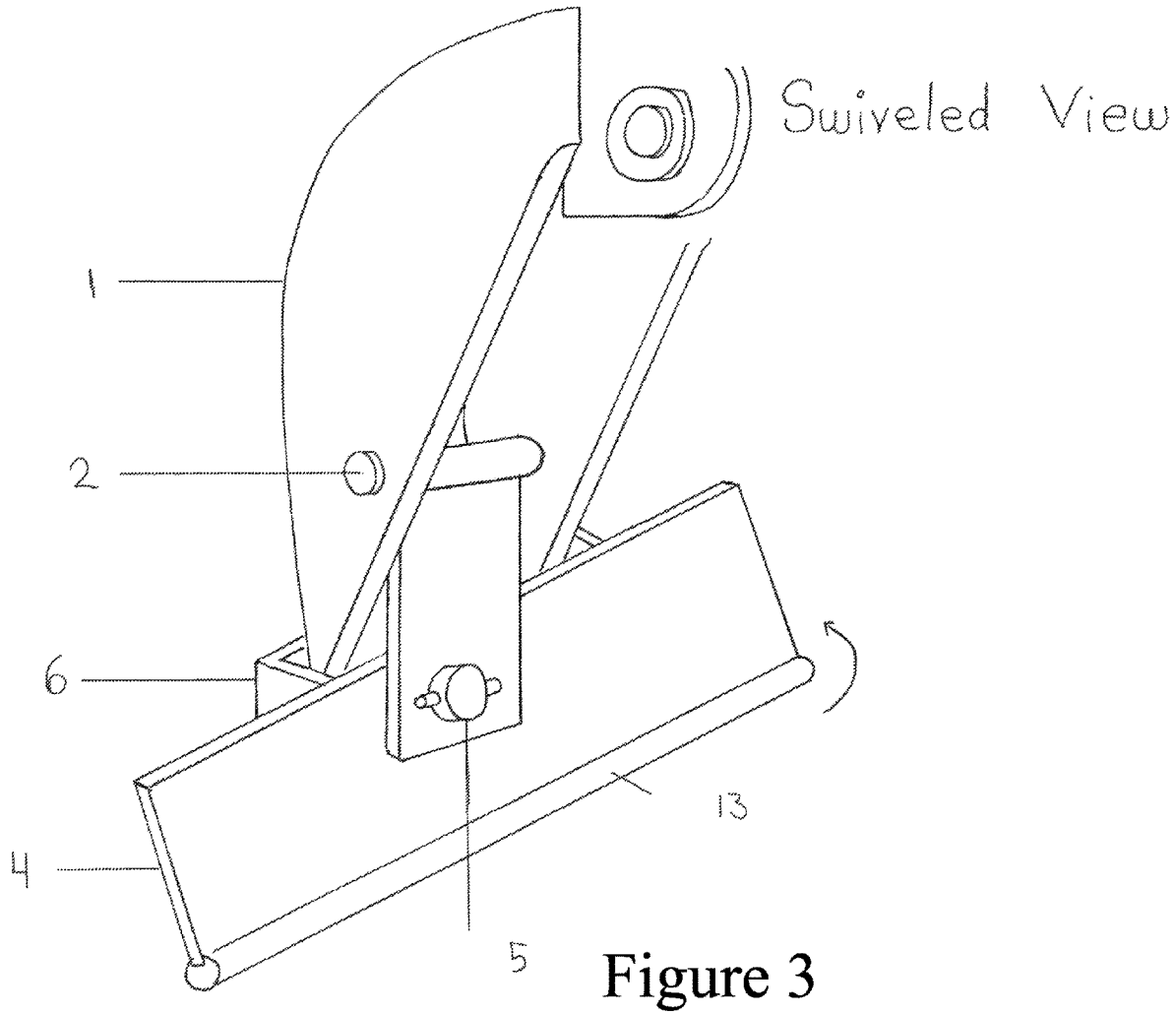
FIG. 3 is a side perspective diagrammatic view of the invention depicting the excavator attachment fully attached to the excavator bucket without depicting components in an exploded configuration.

Referring now to FIG. 1 and FIG. 3 of the drawings simultaneously, there is shown a preferred embodiment of the present invention being a standard excavation bucket 1, a coupling device 9, and a grading blade 4.

The excavator bucket includes two holes 3 on the sides of the bucket that are a size just large enough for a standard metal pin 2 to fit through. These holes 3 can be drilled in the side of any standard excavator bucket 1 using means including using a drill and drill-bit specifically manufactured for drilling holes in metal.

The coupling device 9 is generally a rectangular piece of metal and includes a top portion and a bottom portion. Heavy wall tubing 7 is attached to the top portion of the coupling device 9. The bottom portion of the coupling device 9 includes a centralized hole (not shown).

The grading blade 4 generally includes a standard grading blade used in the construction industry. The grading blade 4 of the present invention includes a circular piece of metal 5 that is flush-welded 10 to the center of the grading blade 4. The circular piece of metal 5 contains small holes on 2 sides (not shown) directly opposite each-other. These holes (not shown) house a spring pin 5A that compresses towards the circular piece of metal 5 when pressure is applied to either side of the spring pin 5A.

The grading blade 4 also includes a solid rod 13 on the bottom of the blade, and a rectangular metal enclosure 6. The solid rod 13 allows for the grading blade 4 to drag smoothly across the ground when operated. The rectangular metal enclosure 6 covers the plurality of excavator bucket 1 teeth, which would otherwise drag or damage the landscape when operating the invention.

The grading blade 4 attaches to the coupling device 9 by inserting the circular piece of metal 5 through the centralized hole (not shown) in the coupling device 9 and then securing the circular piece of metal 5 by inserting a spring pin 5A through the holes of the circular piece of metal 5.

The coupling device 9 is attached to the excavator bucket by inserting the coupling device 9 inside the excavator bucket in line with the bucket holes 3, inserting a metal pin 2 through the bucket holes 3 and the hollow tubing 7, and then securing the metal pin 4 by inserting a lynch pin 8 through the holes in the metal pin 2. This attachment method allows for fast attachment and removal of the present invention to a standard excavator bucket 1 with the simple addition and removal of a metal pin 2 and lynch pin 8.

FIG. 1 shows the present invention attached to the excavator bucket with various components in an exploded view. When attached, the rectangular metal enclosure 6 covers the teeth of the excavator bucket, allowing for the grading blade 4 to drag flush across a surface.

The best mode of operating the present invention is to drill holes 3 in the sides of a standard excavator bucket 1 before beginning to use the excavator at a construction site. Once the operator is ready to begin cleanup or replacement of dirt, the operator should ensure the excavator bucket 1 is oriented with the bucket teeth facing the ground. The operator should then insert the coupling device 9 between the excavator bucket 1 and in line with the holes 3 of the excavator bucket 1. The operator should then insert the metal pin 2 through one hole 3 of the excavator bucket, through the heavy wall tubing 7 of the coupling device 9, then through the second hole 3 of the excavator bucket. Once fully inserted, the operator should secure the metal pin 2 by inserting a lynch pin 8 through the holes of the metal pin 2.

Once the coupling device is secured via lynch pin 8, the operator should attach the grading blade 4 to the coupling device 9 by applying pressure to the spring pin 5A on the circular piece of metal 5 attached to the grading blade 4, and inserting the circular piece of metal 5 of the grading blade 4 through the hole in the coupling device 9. While inserting the circular piece of metal 4 through the hole in the coupling device 9, the operator can release pressure being applied to the spring pin 5A. Then the circular piece of metal 5 is inserted through the hole in the coupling device 9 the spring pin 5A will recompress outwardly and secure the coupling device 9 to the grading blade 4.

Once installed fully, the operator can then operate the invention using the controls of the excavator in the same manner one would use to operate the excavator bucket 1 or a standalone grading blade attachment. However, the operator need not use the same degree of care when operating a fixed grading blade. This is because the circular piece of metal 5 of the present invention allows the grading blade 4 to pivot with the contour of the ground. A standard grading blade or fixed grading blade will drag on a fixed trajectory regardless of whether the ground is bumpy or contours. As the present invention is dragged across the ground, it will pivot with the contours and bumps of the ground, reducing the likelihood of damaging the landscape when using a grading blade.

When the operator is ready to detach the invention, they simply need to apply pressure to the spring pin 5A, remove the circular piece of metal 5 from the hole in the coupling device 9, remove the lynch pin 8, and remove the metal pin 2 from the holes of the excavator 3 and the heavy wall tubing 7. This removal and installation method allows for the use of a grading blade without intricate installation of a fixed device at a construction site and without the need for an entirely different excavator equipped with a standalone grading blade attachment.

Figure 2:
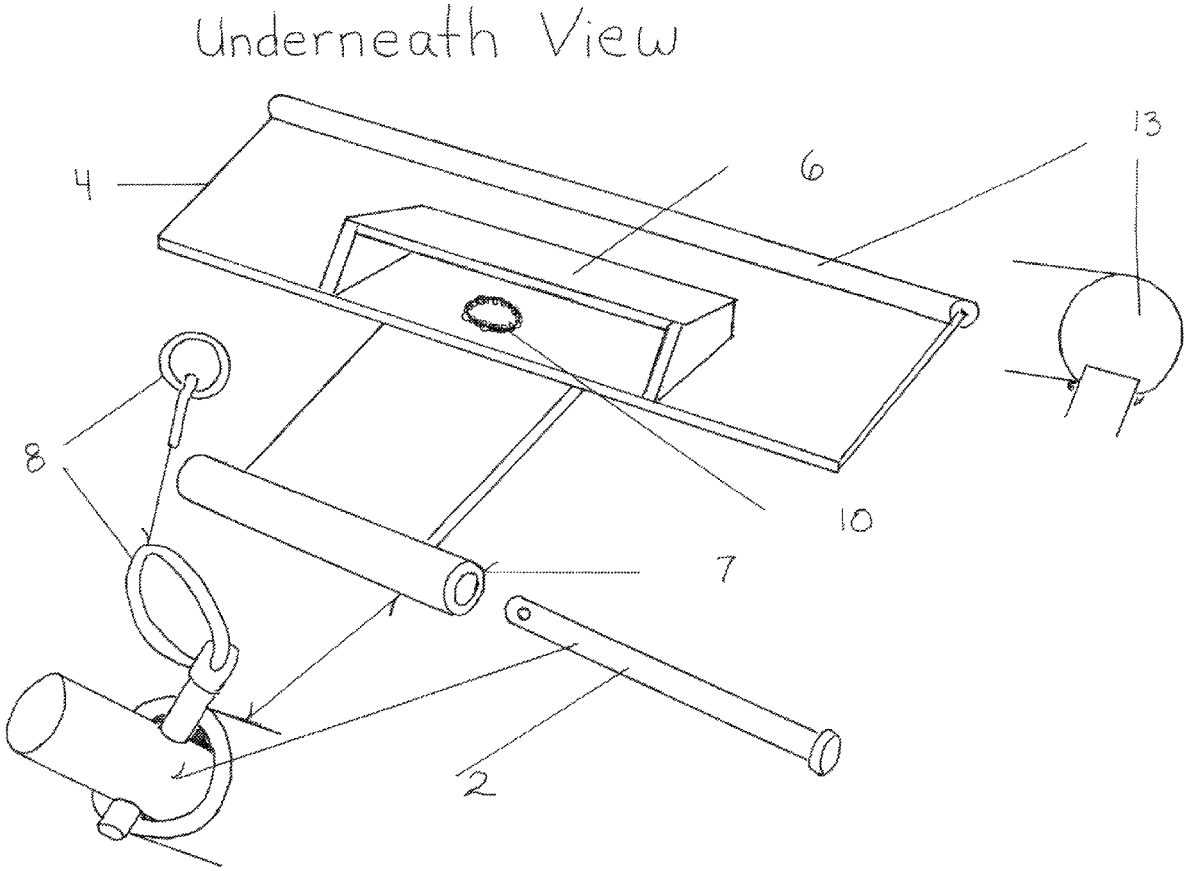
FIG. 2 is a bottom perspective diagrammatic view of the invention depicting various components including attachment components in an exploded configuration.

Referring now to FIG. 2 of the drawings, a bottom view of the grading blade 4 and the coupling device 9 is shown.

Figure 4:
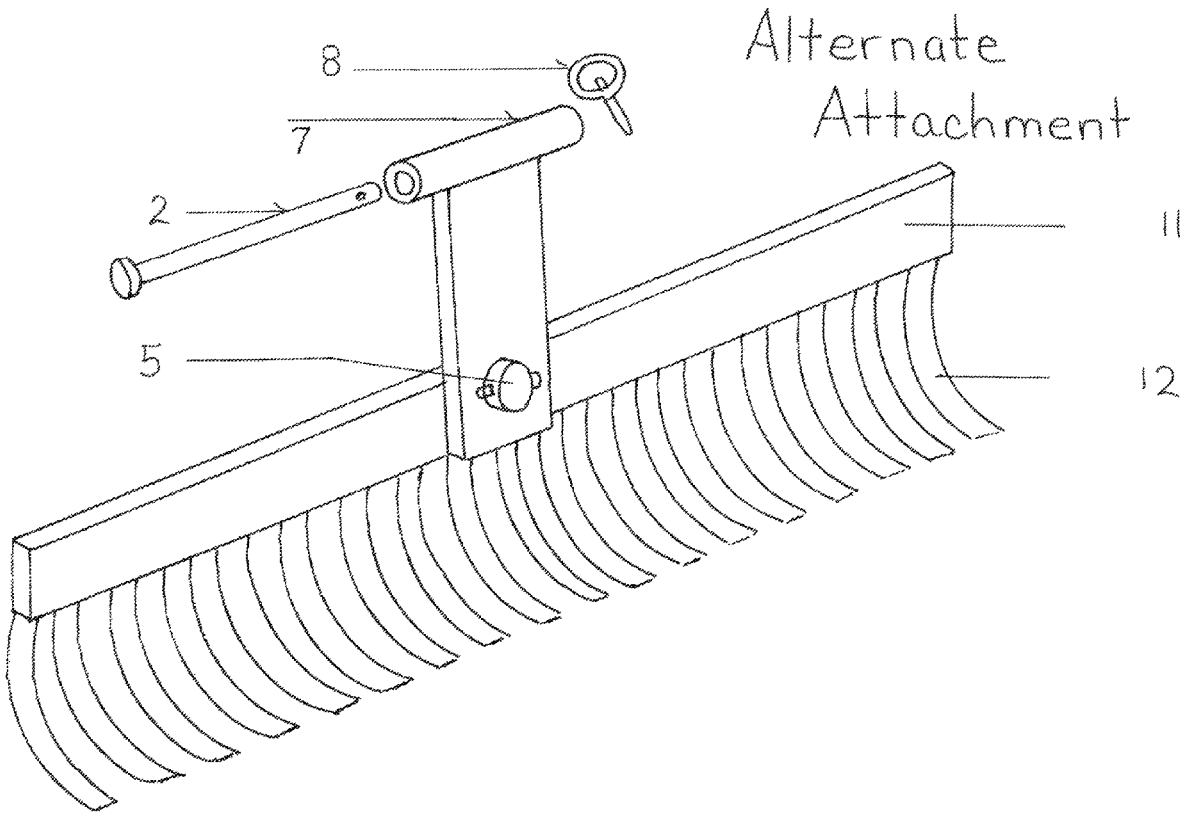
FIG. 4 is a side perspective diagrammatic view of an alternative embodiment of the invention depicting a rake attachment as opposed to a grading blade attachment.

Referring now to FIG. 4 of the drawings, an alternative embodiment is shown wherein the coupling device 9 connects to a rake frame 11. The rake frame 11 includes rake tines 12 that can be used in a similar manner as a grading blade 4 for cleanup of a grass area or for cleanup of a construction area without damaging landscape.

Figure 5:
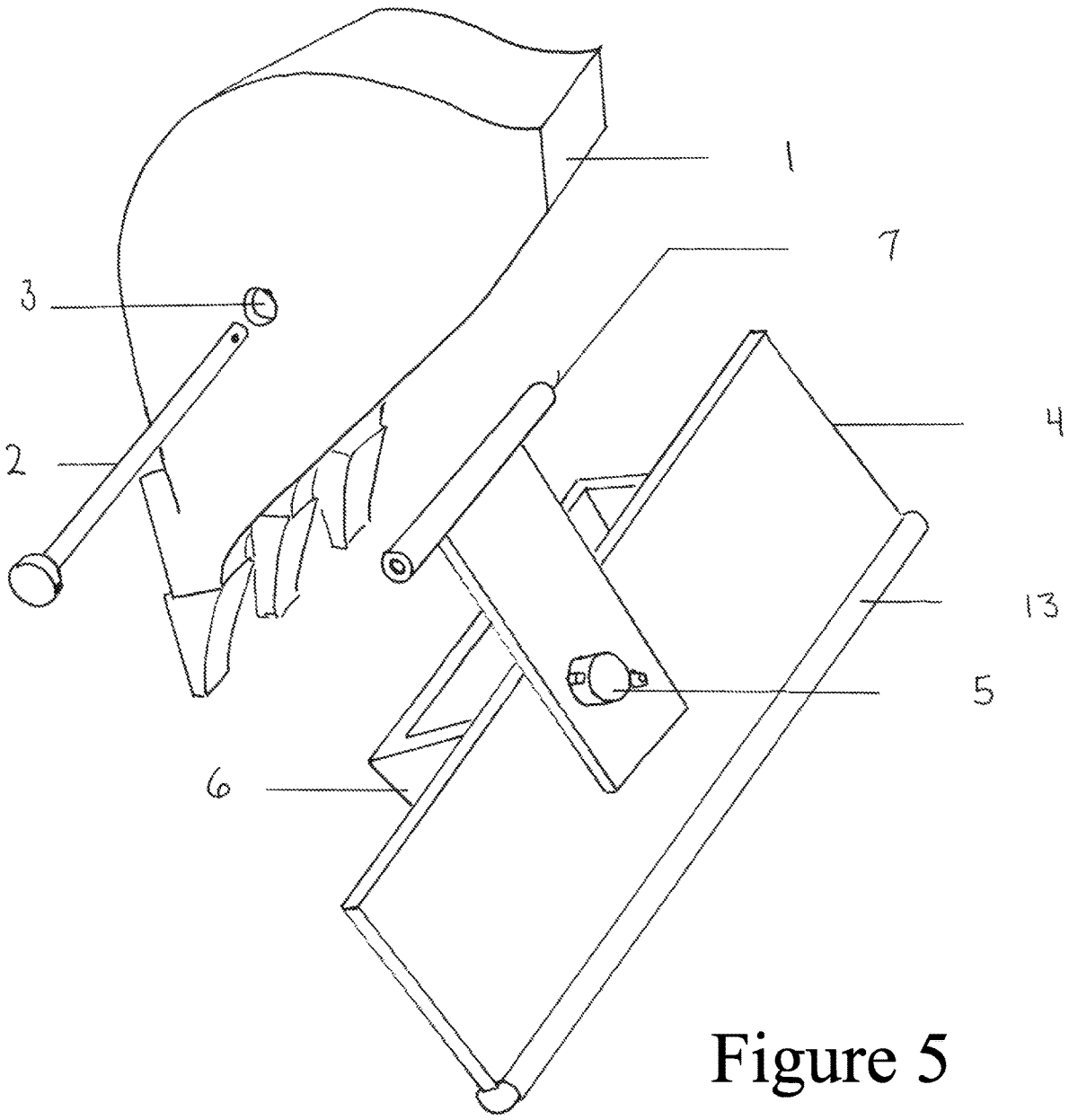
FIG. 5 is a side perspective diagrammatic view of the invention depicting the attachment unconnected to the excavator bucket and indicating how the pin is inserted through the excavator bucket.

Referring now to FIG. 5 of the drawings, a side view of the present invention is shown in an unattached configuration.

I claim:

1. An attachment device comprising:

A coupling, having a rectangular piece of metal that has a width slightly less than the width of the inside of a standard excavator bucket, having a top portion and a bottom portion;

A piece of heavy wall tubing attached to said top portion;

A hole in the middle of said bottom portion;

Said coupling secures to said excavator bucket by inserting said top portion of said coupling device inside said excavator bucket, inserting a metal pin through holes in the side of said excavator bucket and through said heavy wall tubing, and securing said metal pin by inserting a lynch pin into said metal pin;

An attachment that attaches to the coupling device;

said attachment has a circular piece of metal, said circular piece of metal housing a spring pin, and said attachment is removably attached to said coupling device by applying pressure to said spring pin to compress said spring pin, inserting said circular piece of metal through said hole in said coupling device, and releasing pressure from said spring pin.

2. An attachment device as in claim 1, wherein the attachment is a grading blade as commonly understood in the construction industry.

3. An attachment device as in claim 1, wherein said attachment is a grading blade having a front portion and a back portion;

The circular piece of metal is welded to the center of said front portion of said grading blade; and A rectangular enclosure is attached to said back portion that has an opening slightly wider than the width of a standard excavating bucket and having the opening facing away from the bladed part of the grading blade.

4. An attachment device comprising:

A coupling, having a rectangular piece of metal that has a width slightly less than the width of the inside of a standard excavator bucket, having a top portion and a bottom portion;

A piece of heavy wall tubing attached to said top portion;

A hole in the middle of said bottom portion;

Said coupling secures to said excavator bucket by inserting said top portion of said coupling device inside said excavator bucket, inserting a metal pin through holes in the side of said excavator bucket and through said heavy wall tubing, and securing said metal pin by inserting a lynch pin into said metal pin;

An attachment that attaches to said coupling device;

Said attachment has a circular piece of metal, said circular piece of metal housing a spring pin, and said attachment is removably attached to said coupling device by applying pressure to said spring pin to compress said spring pin, inserting said circular piece of metal through said hole in said coupling device, and releasing pressure from said spring pin;

Said attachment is a grading blade as commonly understood in the construction industry.

5. An attachment device as in claim 4, wherein said grading blade has having a front portion and a back portion;

The circular piece of metal welded to the center of said front portion of said grading blade; and A rectangular enclosure attached to said back portion that has an opening slightly wider than the width of a standard excavating bucket and having the opening facing away from the bladed part of the grading blade.

* * * * *